US008304677B2

(12) United States Patent
Yoon

(10) Patent No.: US 8,304,677 B2
(45) Date of Patent: Nov. 6, 2012

(54) HIGH VOLTAGE GAS CIRCUIT BREAKER

(75) Inventor: Jeong Hoon Yoon, Gyeonggi-Do (KR)

(73) Assignee: LS Industrial Systems Co., Ltd., Gyeonggi-Do (KR)

( * ) Notice: Subject to any disclaimer, the term of this patent is extended or adjusted under 35 U.S.C. 154(b) by 407 days.

(21) Appl. No.: 12/648,352

(22) Filed: Dec. 29, 2009

(65) Prior Publication Data

US 2010/0163527 A1 Jul. 1, 2010

(30) Foreign Application Priority Data

Dec. 31, 2008 (KR) ..... 10-2008-0138528

(51) Int. Cl.
*H01H 33/88* (2006.01)

(52) U.S. Cl. ..... 218/78; 218/14; 218/154

(58) Field of Classification Search ..... 218/43, 218/45, 46, 51–64, 67, 76–78, 80
See application file for complete search history.

(56) References Cited

U.S. PATENT DOCUMENTS

| | | | | |
|---|---|---|---|---|
| 4,568,806 | A * | 2/1986 | Frink | 218/57 |
| 6,515,248 | B2 * | 2/2003 | Imamura et al. | 218/59 |
| 2006/0077023 | A1 | 4/2006 | Oh | |

FOREIGN PATENT DOCUMENTS

| | | |
|---|---|---|
| KR | 20-0401944 | 11/2005 |

OTHER PUBLICATIONS

Korean Office Action that issued with respect to Korean Patent Application No. 10-2008-0138528, mailed on Sep. 29, 2010.

* cited by examiner

*Primary Examiner* — Amy Cohen Johnson
*Assistant Examiner* — Marina Fishman
(74) *Attorney, Agent, or Firm* — Greenblum & Bernstein P.L.C.

(57) ABSTRACT

The present invention relates to a high-voltage gas circuit breaker, and there is provided a gas circuit breaker including a movable arc contact and a fixed arc contact engaged with the movable arc contact; a cylinder rod coupled with the movable arc contact; an insulating rod connected to the cylinder rod through a link mechanism in which an end thereof is connected to an operating mechanism; and an ejection nozzle for ejecting an arc-extinguishing gas between the movable arc contact and the fixed arc contact, wherein the link mechanism is reduced in a length direction of the insulating rod to pull the cylinder rod to a side of the insulating rod when the insulating rod is moved apart from the cylinder rod.

6 Claims, 3 Drawing Sheets

HIGH VOLTAGE GAS CIRCUIT BREAKER

CROSS-REFERENCE TO RELATED APPLICATIONS

Pursuant to 35 U.S.C. §119(a), this application claims the benefit of earlier filing date and right of priority to Korean Application No. 10-2008-0138528 filed on Dec. 31, 2008, the contents of which are incorporated by reference herein in its entirety.

BACKGROUND OF THE INVENTION

1. Field of the Invention

The present invention relates to a high-voltage gas circuit breaker, and more particularly, to a gas circuit breaker for blowing an arc-extinguishing gas between a fixed arc contact and a movable arc contact to extinguish an arc during a circuit-breaking operation.

2. Description of the Related Art

Gas insulated switchgear or gas circuit breaker is an electrical device which is provided on an electrical line to safely block a current when switching the line by artificial means in a normal use state or when occurring a fault current such as ground fault or short circuit, thereby protecting a power system or power device. In this gas insulated switchgear, when the switchgear performs a trip operation an arc-extinguishing gas (for example, sulfur hexafluoride ($SF_6$) gas) having an excellent insulation that has been compressed in a compression chamber is ejected to extinguish an arc occurring during the trip operation.

FIG. 1 is a cross-sectional view illustrating a structure of a circuit-breaking portion in a gas insulated switchgear in the related art, and FIG. 2 is a cross-sectional view illustrating an operation state of the circuit-breaking portion of FIG. 1.

As described above, a circuit-breaking portion in a gas insulated switchgear in the related art may include a fixed side and a movable side.

The fixed side is provided with a first fixed contact 1 and a fixed arc contact 2.

The movable side may include a second fixed contact 3, a movable contact 4 movably provided within the second fixed contact 3, a fixed piston 5 provided within the movable contact 4 to form a compression chamber 6, a movable arc contact 7 connected or separated to/from the fixed arc contact 2 while moving along with the movement of the movable contact 4, a nozzle 8 fixed to the movable contact, and a connecting rod 9 connecting a rod 10 of the movable contact 4 to an operating mechanism (not shown) of the switchgear.

In a conducting state of the switchgear, as illustrated in FIG. 1, the movable arc contact 7 is connected to the fixed arc contact 2, the line thereby maintaining a closed path.

When the switchgear being tripped in the foregoing state, a force is transferred to the connecting rod 9 connected to the operating mechanism in a right direction on the drawing (open path direction) to start a high-speed trip operation, and the movable contact 4 and movable arc contact 7 connected to the connecting rod 9 through the rod 10 are moved together in a moving direction of the connecting rod 9.

At this time, a volume of the compression chamber 6 formed by the movable contact 4 and the fixed piston 5 is drastically reduced according to a movement of the movable contact 4 and an arc is thereby generated between the movable arc contact 7 and the fixed arc contact 2 from a moment when the movable arc contact 7 is separated from the fixed arc contact 2 by a movement of the movable contact 4. When an arc is generated as described above, as illustrated in FIG. 2, a compression gas compressed within the compression chamber 6 is ejected in an arc direction through the nozzle 8, thereby extinguishing the arc and blocking the current.

On the other hand, there is a case that a dual motion method is applied thereto in order to increase the speed of separating the movable arc contact 7 and the fixed arc contact 2 and secure a sufficient insulation distance therebetween.

FIG. 3 a cross-sectional view illustrating a structure in which a dual motion method is applied to a gas insulated switchgear in the related art, and FIG. 4 is a cross-sectional view illustrating an operation state of FIG. 3.

As illustrated therein, in a gas circuit breaker with a dual motion method, an operating mechanism operates according to a trip signal and a force is transferred in a right direction on the drawing (open path direction), the nozzle 8, the movable arc contact 7, the movable contact 4, and the rod 10 are thereby moved in a right direction on the drawing, and at the same time, the fixed arc contact 2 is moved in a direction opposite to the moving direction of the movable side (left direction on the drawing) by a reverse link portion 11 connected to a front end of the nozzle 8.

In other words, when a nozzle-side link 12 connected to a front end of the nozzle 8 is moved in a right direction on the drawing, a rotating link 13 thereby rotates in a counterclockwise direction about a fixed pin 15 as a central axis.

As described above, according to the rotation of the rotating link 13, a fixed arc contact-side link 14 connected thereto is moved in a left direction on the drawing, and accordingly, the fixed arc contact 2 fixed to the fixed arc contact-side link 14 is also moved in a left direction on the drawing along with the fixed arc contact-side link.

In other words, in the foregoing structure, the fixed arc contact 2 is moved at the same speed in a direction opposite to the moving direction of the movable side using a moving force of the movable side, thereby multiplying the separation speed and securing a sufficient insulation distance.

SUMMARY OF THE INVENTION

The technical task of the present invention is to provide a overcome the foregoing disadvantage in the related art, and it is a technical subject of the present invention to provide a high-voltage gas circuit breaker for providing a faster blocking speed and a greater insulation distance compared to a high-voltage gas circuit breaker in the related art.

In order to accomplish the foregoing technical task, according to the present invention, there is provided a gas circuit breaker including a movable arc contact and a fixed arc contact engaged with the movable arc contact; a cylinder rod coupled with the movable arc contact; and an insulating rod connected to the cylinder rod through a link mechanism in which an end thereof is connected to an operating mechanism, wherein the link mechanism is reduced in a length direction of the insulating rod to pull the cylinder rod to a side of the insulating rod when the insulating rod is moved apart from the cylinder rod.

In other words, according to the present invention, a gap between the insulating rod and the cylinder rod is reduced while moving the insulating rod by the operating mechanism through the link mechanism, thereby more enhancing a blocking speed and increasing an insulation distance between the fixed arc contact and the movable arc contact.

Preferably, it may further include an ejection nozzle for ejecting an arc-extinguishing gas between the movable arc contact and the fixed arc contact.

Preferably, it may further include a reverse link for moving the fixed arc contact in a direction opposite to the moving direction of the cylinder rod.

Here, the link mechanism may include a 4-bar link in which a pair of vertices facing each other are coupled with ends of the insulating rod and cylinder rod respectively and the remaining vertices of the 4-bar link are inserted into a pair of guide grooves formed within a case accommodating the link mechanism respectively, and a gap between the pair of guide grooves may be established such that the side of the insulating rod is larger than the side of the cylinder rod. Through this, a gap between vertices inserted into the guide grooves of the 4-bar link is widened, and a gap between the cylinder rod and insulating rod is reduced while moving the insulating rod. The gap between the pair of guide grooves may be gradually increased toward the side of the insulating rod, or may be gradually increased subsequent to maintaining a predetermined gap in the initial stage.

According to the present invention, furthermore, there is provided a connecting mechanism of a gas circuit breaker including a case; and a link mechanism provided in an inner side of the case to connect an insulating rod of the gas circuit breaker and an operating mechanism, wherein the link mechanism is reduced in a length direction of the insulating rod when the insulating rod is moved to be pulled out of the gas circuit breaker by the operating mechanism.

Through this, it may be possible to enhance the blocking speed and insulation distance by merely connecting the connecting mechanism to a side of the insulating rod without modifying an existing gas circuit breaker.

Here, the link mechanism may include a pair of guide grooves formed at an inner side of the case; and a 4-bar link in which a pair of vertices facing each other are inserted into the pair of guide grooves and the remaining pair of vertices are connected to an insulating rod of the gas circuit breaker and an operating mechanism respectively, and a gap between the pair of guide grooves may be established such that the side of the insulating rod is larger than the side of the cylinder rod.

According to the present invention having the foregoing configuration, a gap between the insulating rod and the cylinder rod is reduced while moving the insulating rod by the operating mechanism through the link mechanism, thereby more enhancing a blocking speed and increasing an insulation distance between the fixed contact and the movable contact.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a gas circuit breaker according to an embodiment of the present invention will be described in detail with reference to the accompanying drawings.

Figure 1:
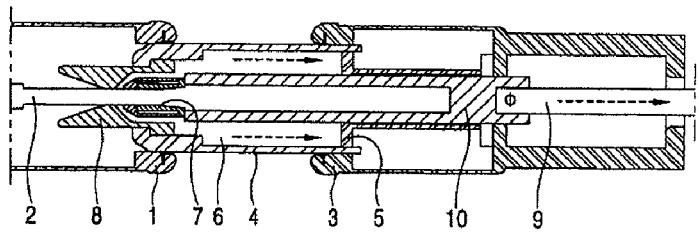
FIG. 1 is a cross-sectional view illustrating a structure of a circuit-breaking portion in a gas insulated switchgear in the related art.
Figure 2:
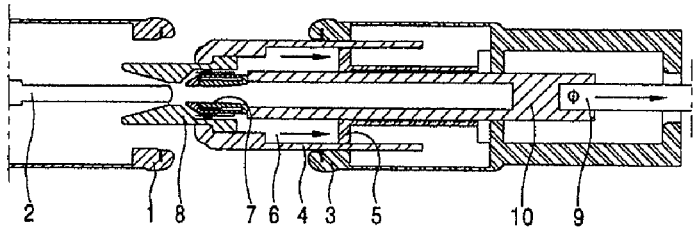
FIG. 2 is a cross-sectional view illustrating an operation state of the circuit-breaking portion of FIG. 1.
Figure 3:
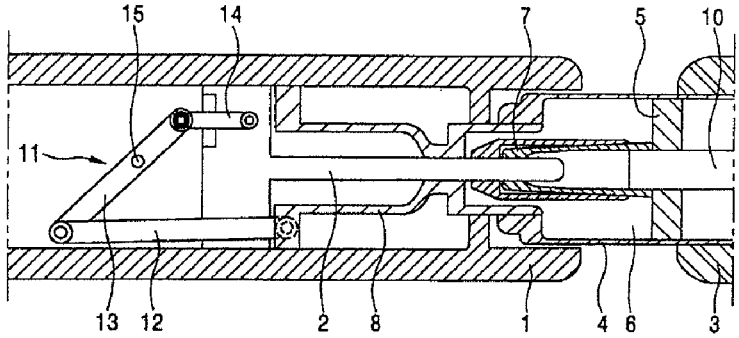
FIG. 3 a cross-sectional view illustrating a structure in which a dual motion method is applied to a gas insulated switchgear in the related art.
Figure 4:
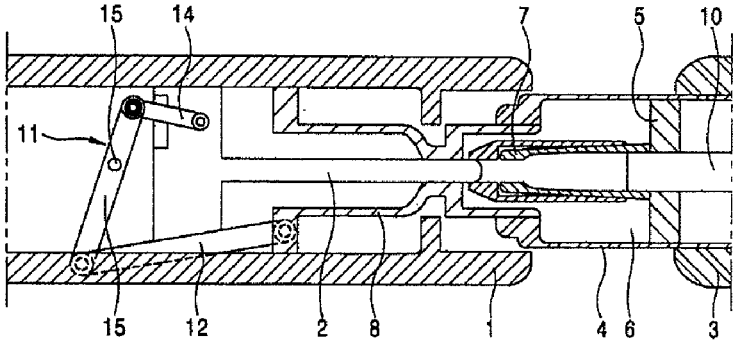
FIG. 4 is a cross-sectional view illustrating an operation state of FIG. 3.
Figure 5:
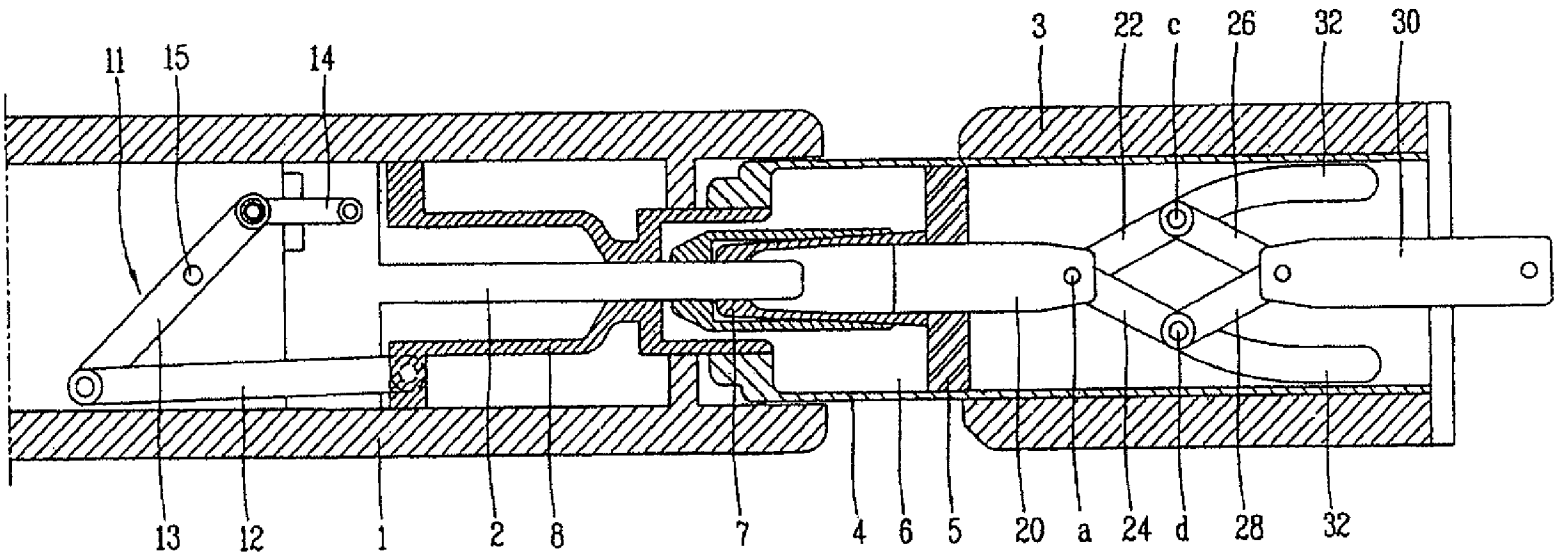
FIG. 5 is a cross-sectional view illustrating a gas circuit breaker according to an embodiment of the present invention.

Referring to FIG. 5, there is illustrated a gas circuit breaker according to an embodiment of the present invention. This embodiment is directed to a gas circuit breaker as illustrated in FIG. 3, and the same or similar constituent elements are designated with the same numeral references and their redundant description will be omitted.

In the foregoing embodiment, a cylinder rod 20 connected to a movable arc contact 7 is back-and-forth movably provided at a fixed piston 5, and a first vertex (a) of a 4-bar link formed by coupling a first to a fourth link members 22, 24, 26, 28 through a hinge is coupled to an end of the cylinder rod 20. On the other hand, a second vertex (b) facing the first vertex (a) is coupled with an end of the insulating rod 30. Accordingly, the cylinder rod 20 and the insulating rod 30 are coupled with each other in a state of being separated from each other by the 4-bar link.

Furthermore, a third and a fourth vertices (c, d) of the 4-bar link are inserted into a pair of guide grooves 32 formed at the second fixed contact 3, and the movement of the third and the fourth vertices (c, d) is thereby restricted along with the guide grooves 32.

Hereinafter, the operation of the foregoing embodiment will be described. Another end of the insulating rod 30 is connected to an operating mechanism (not shown), and thus it may be moved by the operating mechanism in an upward or downward direction in FIG. 5. If the insulating rod 30 is moved by the operating mechanism in a downward direction to separate the movable arc contact from the fixed arc contact, then the 4-bar link and the cylinder rod 20 coupled thereto are also moved in a downward direction, and the fixed arc contact and the movable arc contact are separated from each other.

Figure 6:
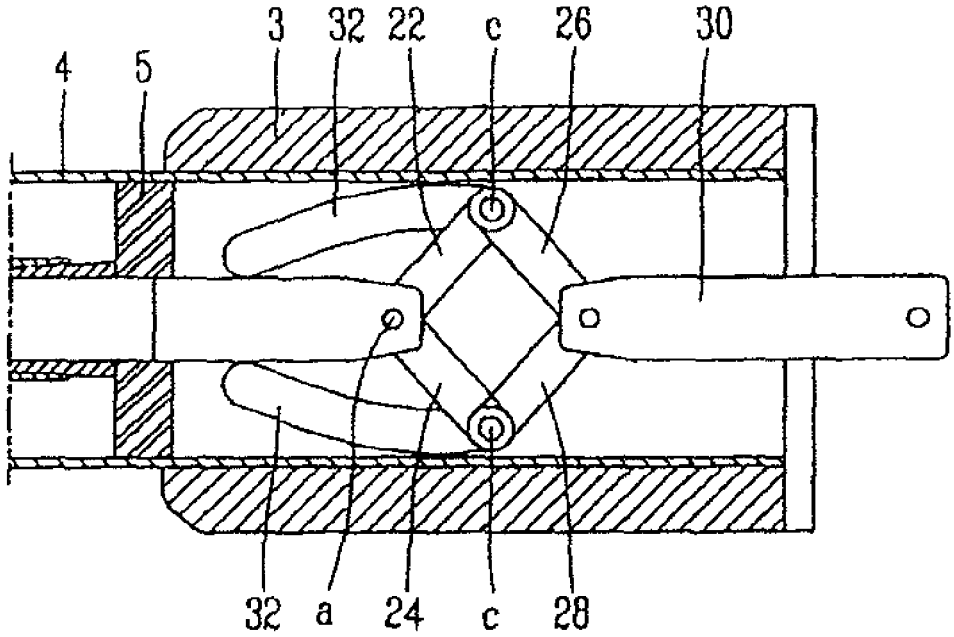
FIG. 6 is a cross-sectional view illustrating an operation state thereof in an embodiment as illustrated in FIG. 5.

At this time, the movement of the third and the fourth vertices (c, d) is restricted along the guide grooves 32, and the 4-bar link is transformed from the shape illustrated in FIG. 5 to the shape illustrated in FIG. 6. Here, the gap between the guide grooves 32 becomes wider and the gap between the third and the fourth vertices (c, d) becomes thereby wider, and accordingly, the gap between the first and the second vertices (a, b) becomes narrower. Due to this, the gap between the cylinder rod 20 and the insulating rod 30 becomes narrower.

As a result, the cylinder rod 20 is moved as much as a distance for which a reduced distance between the first and the second vertices (a, b) of the 4-bar link is added to a moving distance of the insulating rod 30 by the operating mechanism, and thus the cylinder rod 20 is moved faster compared to the insulating rod 30, thereby enhancing the speed of separating the movable arc contact and the fixed arc contact. Moreover, it may be possible to obtain an insulation distance greater than the moving distance of the insulating rod 30.

On the other hand, the present invention may be applied as a form of connecting mechanism that is coupled to a gas circuit breaker. In other words, an example may be considered that the 4-bar link is provided within a case formed with guide grooves thereinside to implement a connecting mechanism and then a first vertex of the 4-bar link is coupled to an end of the rod 10 as illustrated in FIG. 3, and a second vertex thereof is connected to an operating mechanism. Through this, it may be possible to increase the blocking speed and insulation distance without modifying an existing gas circuit breaker.

What is claimed is:

1. A gas circuit breaker, comprising:

a first arc contact and a second arc contact engaged with the first arc contact;

a cylinder rod coupled with the first arc contact; and an insulating rod connected to the cylinder rod through a link mechanism in which an end thereof is connected to an operating mechanism, wherein the link mechanism is reduced in a length direction of the insulating rod to pull the cylinder rod to a side of the insulating rod when the insulating rod is moved apart from the cylinder rod, wherein the link mechanism comprises, a 4-bar link in which a pair of vertices facing each other are coupled with ends of the insulating rod and cylinder rod respectively, and the remaining vertices of the 4-bar link are inserted into a pair of guide grooves formed within a case accommodating the link mechanism respectively, and a gap between the pair of guide grooves is formed such that the side of the insulating rod is larger than the side of the cylinder rod.

2. The gas circuit breaker of claim 1, further comprising:

an ejection nozzle for ejecting an arc-extinguishing gas between the first arc contact and the second arc contact.

3. The gas circuit breaker of claim 1, further comprising:

a reverse link for moving the second arc contact in a direction opposite to the moving direction of the cylinder rod.

4. The gas circuit breaker of claim 1, wherein the gap between the pair of guide grooves is gradually increased toward the side of the insulating rod.

5. A connecting mechanism of a gas circuit breaker, comprising:

a case; and a link mechanism provided in an inner side of the case to connect an insulating rod of the gas circuit breaker and an operating mechanism, wherein the link mechanism is reduced in a length direction of the insulating rod when the insulating rod is moved to be pulled out of the gas circuit breaker by the operating mechanism, wherein the link mechanism comprises, a pair of guide grooves formed at an inner side of the case; and a 4-bar link in which a pair of vertices facing each other are inserted into the pair of guide grooves, and the remaining pair of vertices are connected to an insulating rod of the gas circuit breaker and an operating mechanism respectively, and a gap between the pair of guide grooves is formed such that the side of the insulating rod is larger than the side of the cylinder rod.

6. The connecting mechanism of a gas circuit breaker of claim 5, wherein the gap between the pair of guide grooves is gradually increased toward the side of the insulating rod.

* * * * *